US006058853A

United States Patent [19]

Pinch

[11] Patent Number: 6,058,853

[45] Date of Patent: May 9, 2000

[54] BANQUET TABLE

[75] Inventor: Daniel R. Pinch, Clermont, Fla.

[73] Assignee: Cosco Management, Inc., Wilmington, Del.

[21] Appl. No.: 09/058,012

[22] Filed: Apr. 9, 1998

Related U.S. Application Data

[63] Continuation-in-part of application No. 08/908,625, Aug. 7, 1997

[60] Provisional application No. 60/023,604, Aug. 9, 1996.

[51] Int. Cl.[7] ..... A47B 3/00

[52] U.S. Cl. ..... 108/129; 108/36

[58] Field of Search ..... 108/35, 36, 129, 108/133, 169, 174, 121, 123, 125, 127, 130, 132; 248/188.6

[56] References Cited

U.S. PATENT DOCUMENTS

| | | | |
|---|---|---|---|
| 643,511 | 2/1900 | Lloyd | 108/36 |
| 1,614,187 | 1/1927 | Coggins . | |
| 1,976,140 | 10/1934 | Paul . | |
| 2,542,394 | 2/1951 | Cohen et al. . | |
| 2,730,418 | 1/1956 | Blink . | |
| 2,747,957 | 5/1956 | Lencioni | 108/36 |
| 2,871,076 | 1/1959 | Mell | 108/36 |
| 3,143,982 | 8/1964 | Blink et al. . | |
| 3,170,417 | 2/1965 | Avidiya . | |
| 3,368,504 | 2/1968 | Cohen | 108/36 X |
| 3,416,468 | 12/1968 | Peterson et al. . | |
| 3,777,675 | 12/1973 | Hanusiak . | |
| 4,111,482 | 9/1978 | Jones . | |
| 4,838,180 | 6/1989 | Gutgsell . | |
| 4,862,611 | 9/1989 | Wright . | |
| 5,009,170 | 4/1991 | Spehar | 108/36 |
| 5,109,778 | 5/1992 | Berkowitz et al. . | |
| 5,154,441 | 10/1992 | White et al. . | |
| 5,279,233 | 1/1994 | Cox . | |
| 5,284,100 | 2/1994 | Thorn . | |
| 5,323,713 | 6/1994 | Luyk et al. . | |
| 5,357,872 | 10/1994 | Wilmore . | |
| 5,365,861 | 11/1994 | Gutgsell . | |
| 5,390,610 | 2/1995 | Gutgsell . | |
| 5,394,808 | 3/1995 | Dutro et al. . | |
| 5,421,272 | 6/1995 | Wilmore . | |
| 5,443,020 | 8/1995 | Price | 108/129 X |
| 5,445,085 | 8/1995 | Westerburgen . | |
| 5,540,158 | 7/1996 | Ford . | |
| 5,623,882 | 4/1997 | Price . | |

OTHER PUBLICATIONS

MITY–LITE™ Table & Chairs, catalog, four pages, date unknown.

CORE–A–GATOR™ folding table literature from Vicro Mfg. Corporation, onepage, 1996.

Folding table literature from Business & Institutional Furniture Company, two pages, date unknown.

Folding table literature from Palmer Snyder, two pages, 1996.

Folding table literature, Adirondack Direct catalog, cover sheet and p. 72, date unknown.

Folding table literature, CH Office Products, p. 414, date unknown.

Folding table literature, Meco Corporation, two pages, date unknown.

Folding table advertisement, CHEF'S catalog, p. C598, date unknown.

*Primary Examiner*—Jose V. Chen

*Attorney, Agent, or Firm*—Barnes & Thornburg

[57] ABSTRACT

A table is provided having a table top, a leg assembly coupled to the table top to pivot about a leg pivot axis, and a channel member defining a downwardly facing channel on the table top. The leg assembly includes a leg pivotably coupled to the table top and a support strut pivotably coupled to the leg and slidably coupled to the channel. The table top includes a pair of plastic table sections having rigidified top sheets, a handle recess, a socket/plug combination configured to secure the table sections together, a leg cradle providing a rotative bearing for the leg assembly, and a pair of rails.

52 Claims, 9 Drawing Sheets

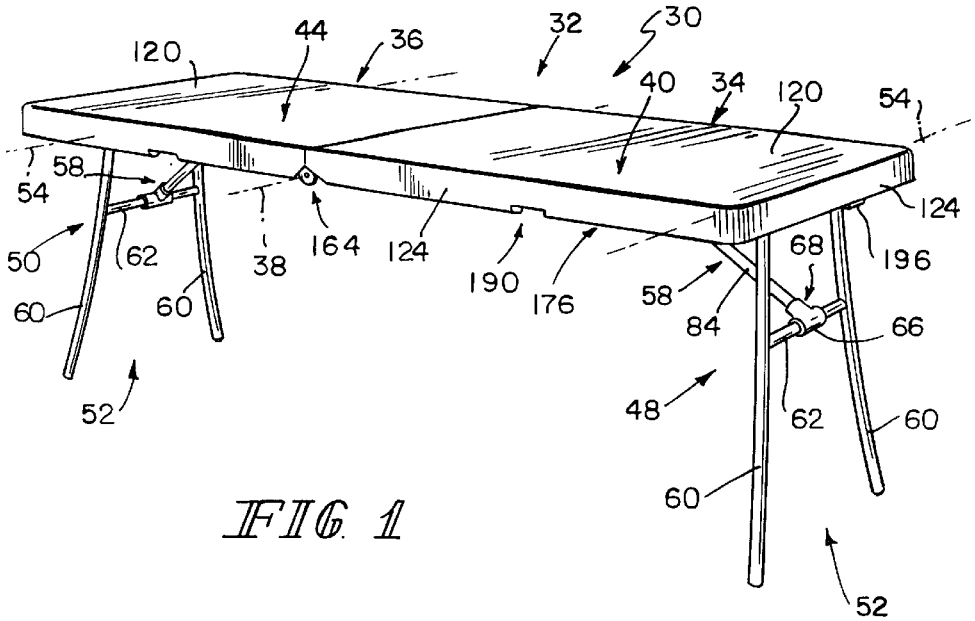
FIG. 1
FIG. 2
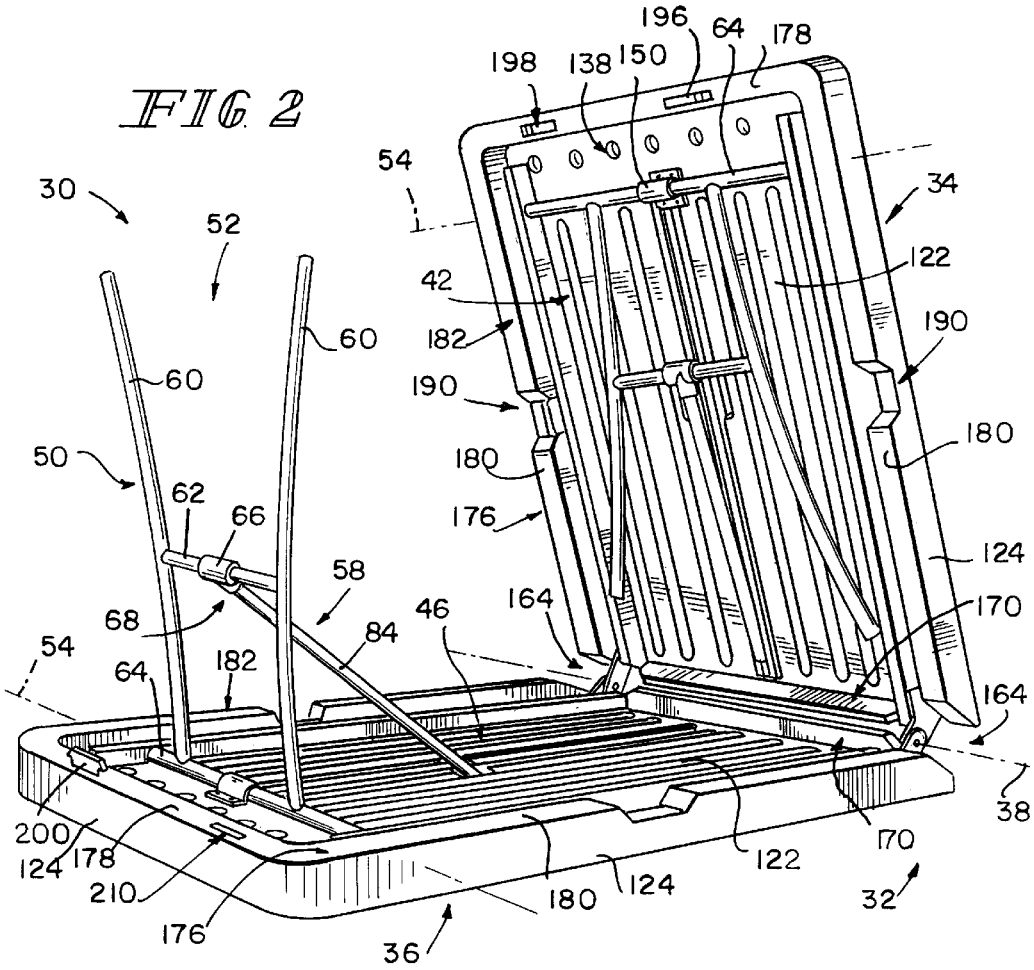

36
124
124
30
32
192
34
154
154
170
170
172
172
154
154
120
164
52
48
60
60
62
66
68
150
64
58
84
70
82
186
156
162
166
188
186
88
80
56
72
158
86
78
156
76
78
188
166
158
132
190
144
146
148
128
196
42
170
152
38
180
46
170
190
182
176
160
146
148
124
152
190
122
180
34
168
124
200
122
32
178
190
210
124
36
30

BANQUET TABLE

This application is continuation-in-part of U.S. patent application Ser. No. 08/908,625, filed Aug. 7, 1997, which claims priority to U.S. Provisional Application Serial No. 60/023,604, filed Aug. 9, 1996 under U.S.C. § 119(e).

BACKGROUND AND SUMMARY OF THE INVENTION

The present invention relates to a folding table, and particularly, to a banquet table having two table sections that can fold between an opened table position in which the table sections are aligned in horizontal relation to form a large table surface and a collapsed position in which the table sections are folded together. More particularly, the present invention relates to folding leg mechanisms attached to each of the table sections and mechanisms that operates to lock the table sections together when the table sections are in the collapsed position.

Folding tables having sections coupled together for movement between an opened table position and a folded collapsed position are known in the art. See for example, U.S. Pat. No. 5,445,085 to Westerburgen; U.S. Pat. No. 5,421,272 to Wilmore; U.S. Pat. No. 5,357,872 to Wilmore; U.S. Pat. No. 3,368,504 to Cohen; U.S. Pat. No. 2,542,394 to Cohen et al.; and U.S. Pat. No. 1,614,187 to Coggins; all of which show examples of folding tables. Many folding tables include legs that can fold relative to the table sections between storage and table-support positions. See, for example, the Wilmore '272 patent and the Wilmore '872 patent, the Cohen '504 patent and the Cohen et al. '394 patent.

Some tables having folding legs include locking mechanisms that lock the legs in an unfolded position. See, for example, U.S. Pat. No. 5,279,233 to Cox and U.S. Pat. No. 5,109,778 to Berkowitz et al. Folding tables having table sections that lock together when the table sections are in the collapsed position are also known. See, for example, the Cohen et al. '394 patent.

In addition, tables made of a plastics material are known in the art. See, for example, U.S. Pat. No. 5,623,882 to Price.

Consumers would welcome a folding table having a pair of folding leg assemblies that compactly store against respective first and second table sections. A light-weight folding table that is easy to carry and that includes mechanisms for locking the leg assemblies in a table-support position and mechanisms for locking the first and second table sections together when the first and second table sections are in a collapsed position would also be desirable to consumers.

According to the present invention, a table includes a table top having a central region and a perimeter around the central region. A channel member defines a channel on the central region of the table top. A folding leg assembly includes a leg coupled to the table top for pivoting movement about a leg pivot axis. The folding leg assembly further includes a support strut pivotably coupled to the leg and coupled to the channel member for sliding movement in the channel. The leg is pivotable about the leg axis between a support position in which the leg lies outside the channel and extends away from the table top and a storage position in which the leg lies outside the channel and adjacent to the table top.

In preferred embodiments, the table top includes a first table section and a second table section coupled to the first table section for pivoting movement about a table pivot axis between an opened table position in which the first and second table sections are aligned in horizontal relation and a collapsed position in which the first and second table sections are folded together. Folding leg assemblies are mounted to each of the first and second table sections.

Each folding leg assembly further includes a pair of latch pins coupled to a respective support strut. Each channel member includes a pair of side walls, each of which is formed to include an aperture. When the legs are moved to the support positions, the associated latch pins are aligned with respective apertures and are spring biased into an extended position received by the apertures to lock the legs in the respective support positions. The latch pins of each folding leg assembly can be manually engaged and moved to a retracted position to unlock the respective leg for movement to the storage position.

In one embodiment of the present invention, each table section is blow molded out of a plastics material. Each blow molded table section is formed to include a recess in which the channel member of the respective folding leg assembly is received. A pair of hand pockets are formed on opposite sides of each recess to provide access to the latch pins so that the latch pins can be engaged and moved from the extended position locking the associated leg in the support position to the retracted position, thereby unlocking the leg for pivoting movement relative to the respective table section.

Each blow molded table section is also formed to include handle recesses along opposite sides of the table section and a plug and socket set adjacent to an outer end of the respective table section. When the table top is folded to the collapsed position the plug of one of the plug and socket sets is received by the socket of the other of the plug and socket sets, and vice versa, to secure the table sections in the collapsed position. In addition, when the table top is folded to the collapsed position, the handle recesses of the first table section cooperate with the handle recesses of the second table section to provide a pair of hand-receiving apertures between the table sections. A person can insert his or her hand into one of the hand-receiving apertures and carry the table.

In another embodiment of the present invention, a first end rail is coupled to the first table section adjacent to the outer end of the first table section and a second end rail is coupled to the second table section adjacent to the outer end of the second table section. When the table sections are folded to the collapsed position, the first end rail is positioned to lie adjacent to the second end rail. A latch is coupled to one of the end rails and can be moved to a locking position in which a hook portion of the latch catches the other of the end rails to lock the first and second table sections in the collapsed position.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 1 is a perspective view of a first embodiment of a folding banquet table in accordance with the present invention showing first and second table sections opened to a table position in which the first and second table sections are aligned in horizontal relation and showing first and second folding leg assemblies beneath each of the first and second table sections, respectively;

FIG. 2 is a perspective view of the table of FIG. 1 flipped over and in a partially-opened position showing the first table section folded about a table pivot axis toward the second table section, the first folding leg assembly in a storage position having a leg of the first folding leg assembly adjacent to the first table section, and the second folding leg assembly in a support position having a leg of the second folding leg assembly extending away from the second table section;

DETAILED DESCRIPTION OF THE DRAWINGS

Figures 3, 4:
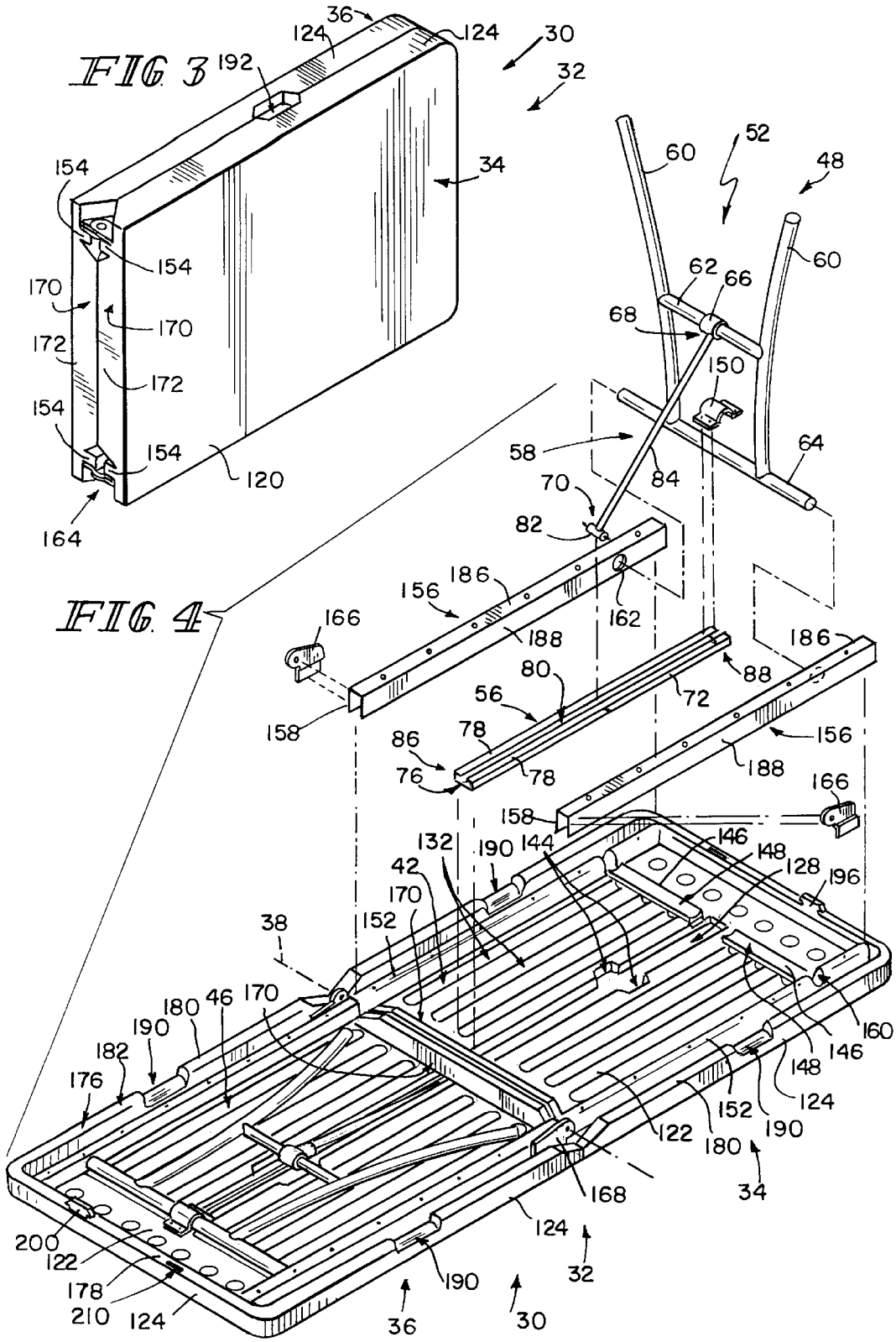
FIG. 3 is a perspective view of the table of FIG. 2 in a collapsed position showing top sides of the first and second table sections facing in opposite directions and handle recesses formed in a side of each table section aligning when the table is in the collapsed position to provide a hand-receiving aperture between the table sections.
FIG. 4 is a partial exploded view of the table of FIG. 1 showing the table sections in the table position aligned in horizontal relation and showing one of the folding leg assemblies exploded away from the companion table section.

A first embodiment folding table 30 according to the present invention is shown in FIGS. 1–14 and a second embodiment folding table 230 according to the present invention is shown in FIGS. 15–24. Table 30 includes a table top 32 having a first table section 34 coupled to a second table section 36 for pivoting movement about a transverse table pivot axis 38 as shown in FIGS. 1–3.

Figures 5, 6, 7, 8:
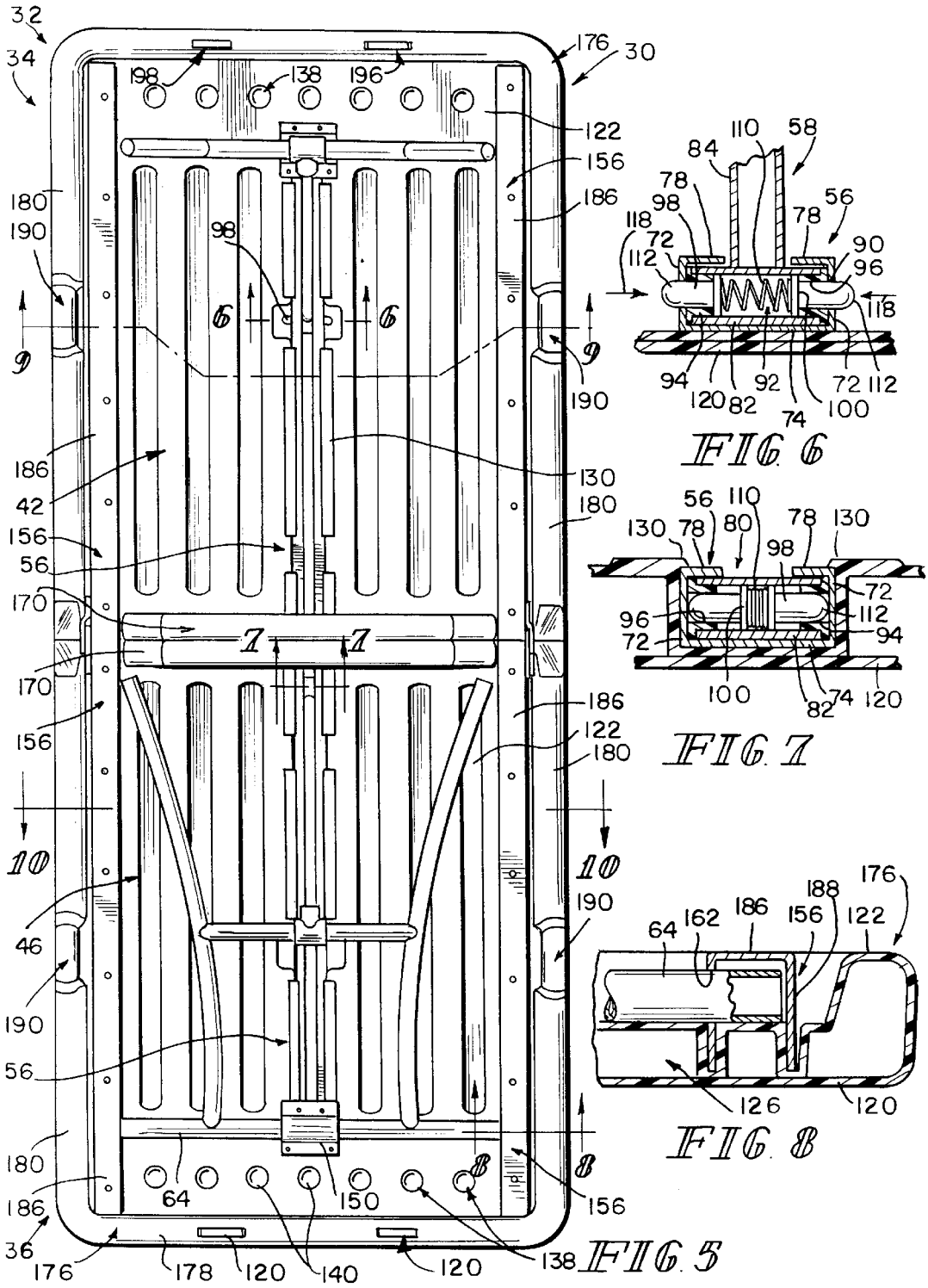
FIG. 5 is a bottom plan view of the table of FIG. 4 showing the first folding leg assembly in the support position (top of page) and showing the second folding leg assembly in the storage position (bottom of page)
FIG. 6 is a sectional view taken along line 6—6 of FIG. 5 showing a support strut of the first folding leg assembly locked to the first table section by an opposing pair of lock pins that are spring-biased through respective apertures formed in a channel member mounted to the first table section.
FIG. 7 is a sectional view taken along line 7—7 of FIG. 5 showing a pair of lock pins of the second leg assembly positioned to lie inside a channel member mounted to the second table section.
FIG. 8 is a sectional view taken along line 8—8 of FIG. 5 showing a pivot member of the leg of the second folding leg assembly abutting a leg cradle of the second table section and showing a reinforcing cover with U-shaped cross-section attached to the second table section, the reinforcing cover including an aperture that receives a portion of the pivot member for pivoting movement.

First and second table sections 34, 36 can pivot about pivot axis 38 between an opened table position in which table sections 34, 36 are horizontally aligned, as shown in FIGS. 1, 4, and 5, and a folded collapsed position in which table sections 34, 36 are folded together, as shown in FIG. 3. When table sections 34, 36 are in the collapsed position, table 30 can be stored, for example, in a closet or any other suitable storage space. A hand-receiving aperture 192, shown in FIG. 3, is created when table sections 34, 36 are in the collapsed position so that table 30 can be easily carried. In addition, a plug 196 and a socket 198 of first table section 34 mate with a socket 210 and a plug 200, respectively, of second table section 36 to secure table sections 34, 36 in the collapsed position.

First table section 34 includes a top side 40 and an underside 42 and second table section 36 includes a top side 44 and an underside 46. When table sections 34, 36 are in the table position, top sides 40, 44 form a large table surface. When table sections 34, 36 are in the collapsed position, underside 42 faces underside 46 in confronting relation and top sides 40, 44 face in opposite directions.

A first folding leg assembly 48 is coupled to underside 42 of first table section 34 and a second folding leg assembly 50 is coupled to underside 46 of second table section 36. Each folding leg assembly 48, 50 includes a leg 52 that can pivot about a transverse leg pivot axis 54 between a support position in which leg 52 extends away from the respective underside 42, 46 and a storage position in which leg 52 is folded against the respective underside 42, 46.

A channel member 56 is situated in a central region of each table section 34, 36 and a support strut 58 of respective folding leg assemblies 48, 50 extends between each leg 52 and the respective channel member 56. As legs 52 are moved between the support and storage positions, support struts 58 pivot relative to respective legs 52 and slide relative to respective channel members 56. When legs 52 reach their support positions support struts 58 are locked to respective channel members 56, thereby locking legs 52 in the support positions.

When both folding leg assemblies 48, 50 are in the support position and table sections 34, 36 are in the table position, table 30 is in a standard table configuration, shown in FIG. 1, in which legs 52 support table top 32 above a floor (not shown) and top sides 40, 44 face upwardly. When folding leg assemblies 48, 50 are both in the storage positions, table sections 34, 36 can pivot about pivot axis 38 to the collapsed position without interference from folding leg assemblies 48, 50.

First folding leg assembly 48 and the operation of first folding leg assembly 48 is substantially the same as second folding leg assembly 50 and the operation of second folding leg assembly 50. Therefore, the description below of first folding leg assembly 48 and the operation of first folding leg assembly 48 is also descriptive of second folding leg assembly 50 and the operation of second folding leg assembly 50 unless specifically noted otherwise.

Folding leg assembly 48 includes leg 52 coupled to underside 42 of table section 34 for pivoting movement about pivot axis 54 as previously described. A channel member 56 is mounted to underside 42 and folding leg assembly 48 includes a support strut 58 coupling leg 52 to channel member 56 as shown, for example, in FIGS. 2, 4 and 5. Leg 52 includes a pair of spaced-apart curved uprights 60, a cross strut 62 extending transversely between uprights 60, and a pivot member 64 to which upper portions of uprights 60 are attached as shown in FIGS. 2 and 4. Support strut 58 includes a first end 68 coupled to cross strut 62 for pivoting movement. Support strut 58 also includes a second end 70 coupled to channel member 56 for sliding movement. First end 68 of support strut 58 includes a collar tube 66 that receives cross strut 62 therethrough so that support strut 58 is pivotably coupled to leg 52.

Channel member 56 includes a pair of spaced-apart elongated side walls 72 and an elongated top wall 74 connecting side walls 72 so that a channel 76 having uniform height and width is defined between side walls 72. Channel member 56 also includes a pair of spaced-apart strut-retention walls 78, each of which is connected to one of side walls 72. Strut-retention walls 78 extend away from respective side walls 72 in perpendicular relation therewith to cover a portion of channel 76 as shown in FIGS. 6 and 7. Strut-retention walls 78 are spaced apart to define a strut-receiving gap 80 therebetween, as shown best in FIGS. 6 and 7.

Second end 70 of support strut 58 includes a transverse end tube 82 and support strut 58 includes a single tubular bar 84 extending through strut-receiving gap 80 from end tube 82 to collar tube 66. Outer portions of end tube 82 are positioned to lie between respective strut-retention walls 78 and top wall 74 so that end tube 82 is trapped within channel 76 between side walls 72 of channel member 56.

Channel member 56 includes a first end 86 adjacent to pivot axis 38 and a second end 88 adjacent to pivot member 64 of leg 52 as shown in FIG. 4. When folding leg assembly 48 is in the storage position having leg 52 adjacent to underside 42, end tube 82 is positioned to lie adjacent to first end 86 of channel member 56. In addition, support strut 58 is in a folded position having collar tube 66 of support strut 58 positioned to lie adjacent to underside 42, as shown, for example, in FIG. 2.

As leg 52 pivots about pivot axis 54 from the storage position toward the support position, cross strut 62 of leg 52 pulls collar tube 66 and first end 68 of support strut 58 away from underside 42. Pivoting movement of leg 52 about pivot axis 54 toward the support position also causes end tube 82 to slide in channel 76 away from first end 86 of channel member 56 and toward second end 88 of channel member 56. As end tube 82 slides in channel 76, collar tube 66 and tubular bar 84 pivot relative to cross strut 62. When leg 52 reaches the support position, support strut 58 is in an unfolded position having collar tube 66 of support strut 58 spaced apart from underside 42 of first table section 34 as shown, for example, in FIG. 9.

Each side wall 72 of channel member 56 is formed to include an aperture 90. End tube 82 includes an interior region 92 and an end plug 94 is mounted in each end of end tube 82 so that a portion of each end plug 94 is received in interior region 92 as shown in FIGS. 6 and 7. Each end plug 94 is formed to include a bore 96. A pair of lock pins 98 are received in interior region 92 and extend through bore 96 of respective end plugs 94. Each lock pin 98 is formed to include a disk portion 100. A spring 110 is positioned to lie between lock pins 98 and opposite ends of spring 110 engage respective disk portions 100 to bias lock pins 98 into an extended position, shown in FIG. 6, in which disk portions 100 contact respective end plugs within interior region 92 of end tube 82. Each lock pin 98 includes an outer tip 112 that is positioned to lie outside channel 76 and beyond the respective side wall 72 of channel member 56 when the respective lock pin 98 is in the extended position.

Figure 9:
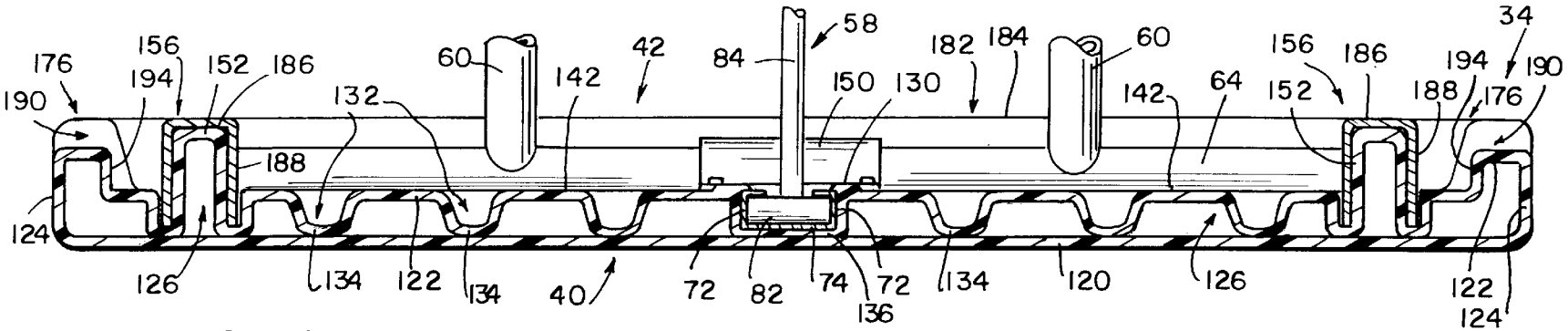
FIG. 9 is a sectional view taken along line 9—9 of FIG. 5 showing the first table section being substantially hollow and an underside of the first table section having a somewhat corrugated-like texture.

When leg 52 is in the support position, having support strut 58 in the unfolded position, end tube 82 is positioned to lie between apertures 90 formed in side walls 72 of channel member 56 and spring 110 biases lock pins 98 into and through respective apertures 90. Receipt of lock pins 98 in apertures 90 prevents end tube 82 from sliding relative to channel member 56 within channel 76, thereby locking leg 52 in the support position. Apertures 90 are formed as angled slots as shown in FIG. 9.

A person can unlock leg 52 by engaging outer tips 112 of lock pins 98 and pushing lock pins 98 inwardly toward one another in the direction of arrows 118, shown in FIG. 6. Pushing lock pins 98 in respective directions 118 further compresses spring 110 between disk portions 100 of lock pins 98. Outer tip 112 of each lock pin 98 is rounded so that when lock pins 98 have been moved in directions 118 a sufficient amount, end tube 82 can slide relative to channel member 56 within channel 76. When end tube 82 is initially moved away from apertures 90, camming engagement between lock pins 98 and side walls 72 of channel member 56 moves lock pins 98 to a retracted position, shown in FIG. 7, in which lock pins 98 are completely inside channel 76. When lock pins 98 are in the retracted position, spring 110 biases outer tips 112 of latch pins 98 into contact with respective side walls 72 of channel member 56.

Side walls 72 of channel member 56 are spaced apart by an amount that allows a person to use only one hand to engage and move lock pins 98 in direction 118. For example, the person can engage one of lock pins 98 with his or her thumb and can engage the other of lock pins 98 with his or her first finger and then, by use of a squeezing motion, the person can move lock pins 98 in respective directions 118. The person can use his or her other hand to grasp leg 52 and to guide the movement of leg 52 from the support position to the storage position.

After each lock pin 98 has been moved to the respective retracted position, leg 52 can pivot about pivot axis 54 to the storage position. As leg 52 pivots toward the storage position, cross strut 62 of leg 52 pushes collar tube 66 and tubular bar 84 of support strut 58 toward underside 42. Pivoting movement of leg 52 about pivot axis 54 toward the storage position also causes end tube 82 to slide in channel 76 toward first end 86 of channel member 56 and away from second end 88 of channel member 56. As end tube 82 slides in channel 76, collar tube 66 and tubular bar 84 pivot relative to cross strut 62. When leg 52 reaches the storage position, support strut 58 is in a folded position having collar tube 66 and tubular bar 84 of support strut 58 adjacent to underside 42 of first table section 34 as shown, for example, in FIG. 2 with reference to first folding leg assembly 48. Thus, both leg 52 and support strut 58 lie substantially flat against underside 42 and channel member 56 when in the respective storage and folded positions.

Leg 52 is positioned to lie outside channel 76 when leg 52 is in both the support and storage positions. In addition, collar tube 66 is positioned to lie adjacent to strut-retention walls 78 when leg 52 is in the storage position so that cross strut 62 extends across strut-receiving gap 80 as shown, for example, in FIG. 2.

Illustrative first and second table sections 34, 36 of first embodiment folding table 30 are made out of a plastics material that is blowmolded to form each table section 34, 36. Each of first and second table sections 34, 36 includes a top sheet of plastic 120 at the top sides 40, 44 thereof, a bottom sheet of plastic 122 at the undersides 42, 46 thereof, and a perimetral side sheet of plastic 124 integrally connecting the respective top and bottom sheets of plastic 120, 122 together as shown, for example, in FIGS. 9 and 10. Perimetral side sheet of plastic 124 defines the outer perimeter of each table section 34, 36. Top sheets of plastic 120 and bottom sheets of plastic 122 cooperate with respective perimetral side sheets of plastic 124 to define a table body that encloses an interior region 126 of each table section 34, 36.

Each bottom sheet of plastic 122 is formed to include a longitudinal recess 128 as shown in FIG. 4. Recess 128 is sized to receive respective channel members 56 therein. Each bottom sheet of plastic 122 is formed to include a plurality of retention ribs 130 that engage portions of strut-retention walls 78 of respective channel members 56 to retain channel members 56 in respective recesses 128. Each bottom sheet of plastic 122 is also formed to include a plurality of longitudinal grooves 132 extending alongside respective recesses 128. Grooves 132 provide undersides 42, 46 of respective table sections 34, 36 with somewhat of a corrugated-like texture.

A portion 134 of bottom sheets of plastic 122 adjacent to each of grooves 132 and a portion 136 of bottom sheets of plastic 122 adjacent to each recess 128 engage respective top sheets of plastic 120 to support and rigidify the respective top sheets of plastic 120. Bottom sheet of plastic 122 is also formed to include a plurality of domes 138 and a portion 140 of bottom sheets of plastic 122 adjacent to respective domes 138 engages respective top sheets of plastic 120 to support and rigidify the respective top sheets of plastic 120. It is within the scope of the invention as presently perceived for bottom sheets of plastic 122 to be formed in a variety of contours to support and rigidify top sheets of plastic 120.

Figure 10:
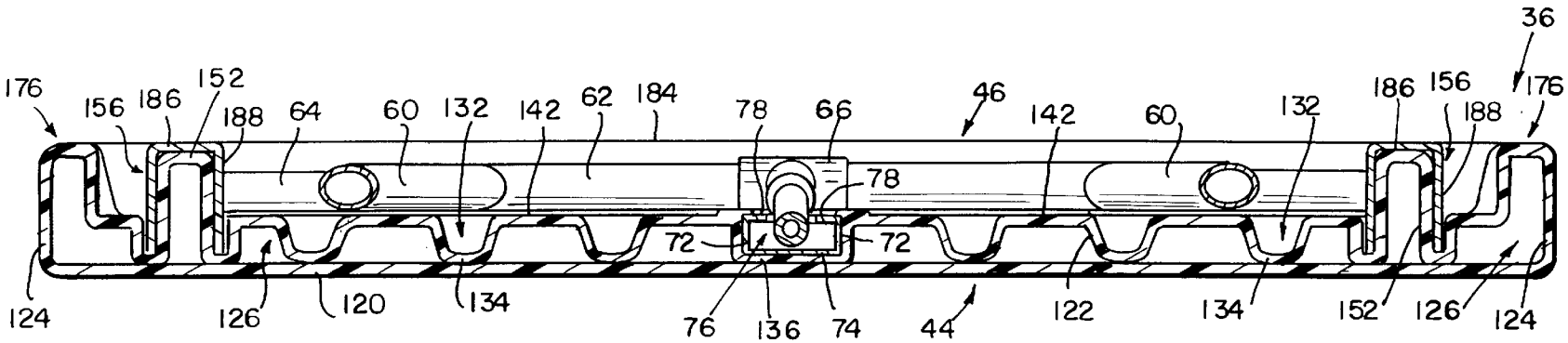
FIG. 10 is a sectional view taken along line 10—10 of FIG. 5 showing the leg of the second folding leg assembly in the storage position adjacent to an underside of the second table section.
Figure 11:
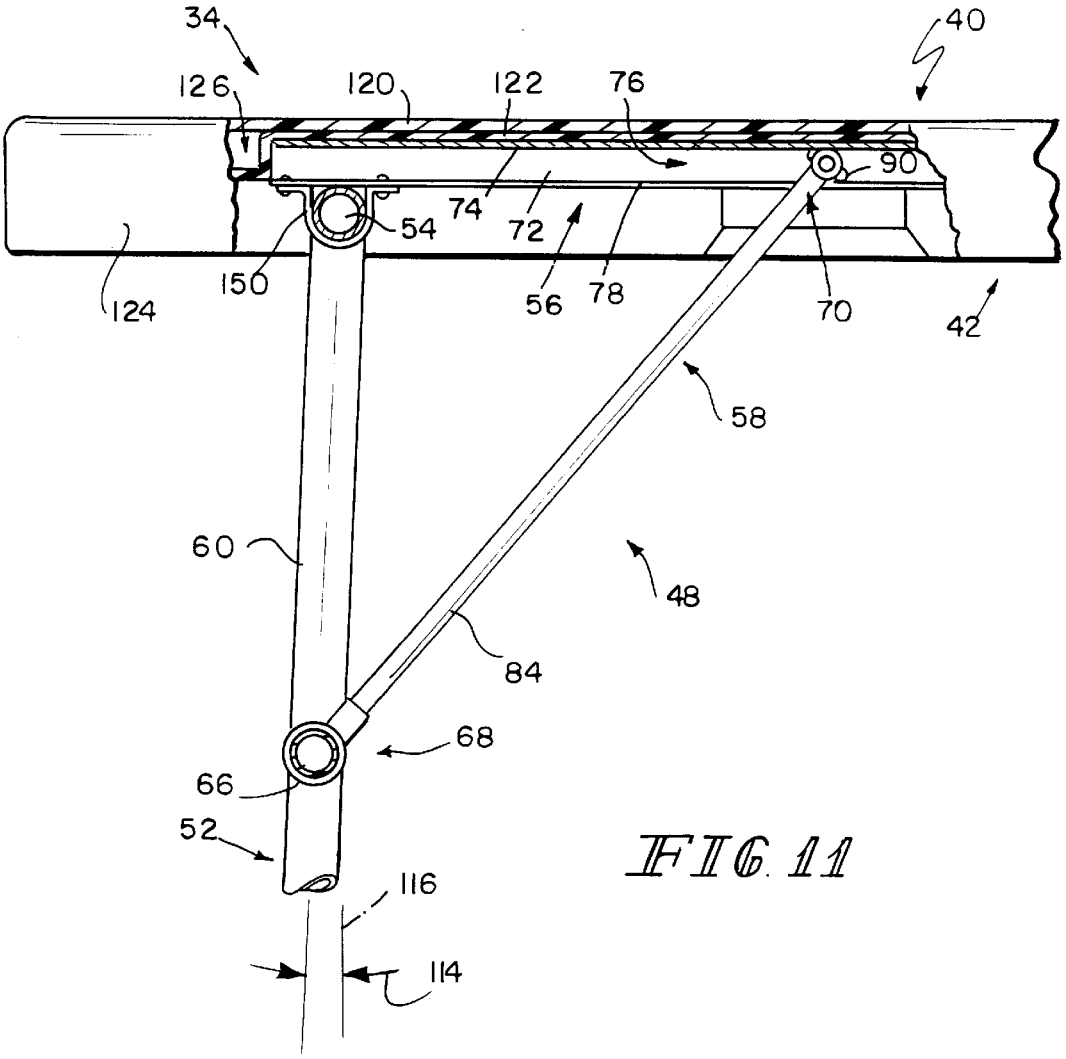
FIG. 11 is a side elevation view of the table of FIG. 1 in the table position, with portions broken away, showing a mounting bracket coupling the pivot member of the leg of the first folding leg assembly to the first table section and showing the support strut of the first folding leg assembly locking the leg of the first leg assembly in the support position.

Portions of bottom sheets of plastic 122 that are between grooves 132 and that are spaced apart from respective top sheets of plastic 120 cooperate to define a bottom surface plane 142 as shown, for example, in FIGS. 9 and 10. Channel members 56 are positioned to lie between respective bottom surface planes 142 and top sheets of plastic 120 when received in respective recesses 128.

Each bottom sheet of plastic 122 is formed to include a pair of opposing hand pockets 144 that are integral with the associated recesses 128 as shown in FIG. 4. Apertures 90 formed in side walls 72 of respective channel members 56 are adjacent to respective hand pockets 144. When lock pins 98 are each in the extended position extending through apertures 90, outer tip 112 of each lock pin 98 is positioned to lie in the respective hand pocket 144. A user can insert one or more of his or her fingers into one of hand pockets 144 and can insert his or her thumb into the opposite hand pocket 144 to engage outer tips 112 of lock pins 98 and move lock pins 98 to the retracted positions as describe above. Thus, hand pockets 144 provide a user with access to respective lock pins 98 so that leg 52 can be unlocked and moved from the support position to the storage position.

Each bottom sheet of plastic 122 is formed to include a pair of leg cradles 146. Leg cradles 146 are separated by the portion of respective recesses 128 that receives second ends 88 of respective channel members 56 as shown best in FIG. 4. Leg cradles 146 each include a curved surface 148 that provides rotative bearing engagement between pivot member 64 and respective table sections 34, 36.

A mounting bracket 150 is fastened to respective channel members 56 and to respective bottom sheets of plastic 122 as shown in FIGS. 2, 4, 9 and 11. Each mounting bracket 150 is positioned to lie between respective uprights 60 and a center portion of pivot member 64 of each leg 52 is positioned to lie between the respective mounting bracket 150 and channel member 56. Mounting brackets 150 hold pivot members 64 against respective leg cradles 146.

Each bottom sheet of plastic 122 is formed to include a pair of spaced-apart longitudinal support rails 152. Support rails 152 each have a generally U-shaped cross section as shown in FIGS. 9 and 10. Perimetral side sheets of plastic 124 includes portions 154 that provide a closed end of respective support rails 152 adjacent to table pivot axis 38 as shown in FIG. 3. When first and second table sections 34, 36 are in the table position, portions 154 associated with support rails 152 of first table section 34 abut portions 154 associated with support rails 152 of second table section 36. Abutment of portions 154 of first table section 34 with those of second table section 36 helps to support first and second table sections 34, 36 in the table position.

A reinforcing cover 156 covers each of support rails 152 as shown in FIGS. 2, 4, 9 and 10. Reinforcing covers 156 each have a U-shaped cross section and are sized to closely mate with respective support rails 152. A fastener, such as a plurality of Termax (Trademark?) fasteners (not shown) or other suitable fastening devices, can be used to fasten reinforcing covers 156 to respective support rails 152. Reinforcing covers 156 are made of a material, such as metal, that is stronger than the plastics material of support rails 152. Each reinforcing cover 156 includes an end edge 158 adjacent to table pivot axis 38. End edges 158 of reinforcing covers 156 associated with first table section 34 abut end edges 158 of reinforcing covers 156 associated with second table section 36 to provide added rigidity to table 30 when first and second table sections 34, 36 are in the table position.

Each support rail 152 is formed to include a leg-receiving notch 160 and each reinforcing cover 156 is formed to include an aperture 162 that is positioned to lie adjacent to the leg-receiving notch 160 of the companion support rail 152. Opposite ends 164 of pivot member 64 of respective legs 52 are received by respective apertures 162 and leg-receiving notches 160. Thus, reinforcing covers 156 cooperate with mounting bracket 150 to couple legs 52 to respective table sections 34, 36 for pivoting movement about respective leg pivot axes 54.

Table 30 includes a pair of hinges 164, each of which includes a first hinge plate 166 fastened to a respective reinforcing cover 156 mounted to first table section 34 and a second hinge plate 168 fastened to a respective reinforcing cover 156 mounted to second table section 36 as shown in FIGS. 2 and 10. First hinge plates 166 are pivotably coupled to respective second hinge plates 168 at table pivot axis 38, thereby coupling first and second table sections 34, 36 together for pivoting movement about table pivot axis 38.

Figure 12:
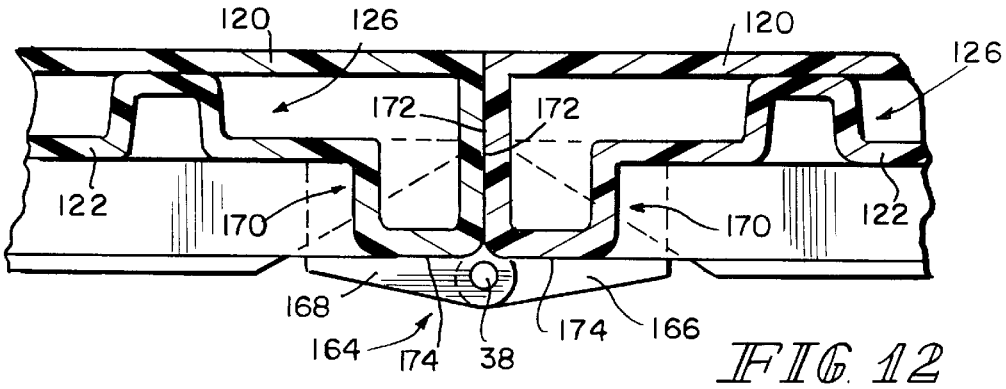
FIG. 12 is an enlarged side elevation view of the table of FIG. 1, with portions broken way, showing an abutment rail of the first table section abutting an abutment rail of the second table section when the first and second table sections are in the table position and showing a hinge coupling the first and second table sections together at the table pivot axis.

Each bottom sheet of plastic 122 of blowmolded table sections 34, 36 cooperates with respective perimetral side sheets of plastic 124 to provide each table section 34, 36 with a transverse abutment rail 170 adjacent to and parallel with table pivot axis 38 as shown in FIGS. 4, 5 and 12. Each abutment rail 170 includes a first abutment surface 172 and a second abutment surface 174 that is perpendicular to first abutment surface 172. When first and second table sections 34, 36 are in the table position, first abutment surface 172 of abutment rail 170 associated with first table section 34 engages first abutment surface 172 of abutment rail 170 associated with second table section 174 as shown in FIG. 10. Engagement of first abutment surfaces 172 of abutment rails 170 provides added rigidity to table 30 when first and second table sections 34, 36 are in the table position.

When first and second table sections 34, 36 are in the collapsed position, second abutment surface 174 of abutment rail 170 associated with first table section 34 engages second abutment surface 174 of abutment rail 170 associated with second table section 174 as shown in FIG. 3. In addition, first abutment surfaces 172 of abutment rails 170 are aligned in coplanar relation and abutment rails 170 substantially close off access to the space between the first and second table sections 34, 36 when first and second table sections 34, 36 are in the collapsed position.

Each bottom sheet of plastic 122 of blow molded table sections 34, 36 cooperates with respective perimetral side sheets of plastic 124 to provide each table section 34, 36 with an outer perimetral rim 176 having a transverse end portion 178 arranged in spaced-apart parallel relation with table pivot axis 38 and having a pair of spaced-apart side portions 180 that extend from end portion 178 toward table pivot axis 38. Thus, each outer perimetral rim is generally U-shaped as shown in FIG. 5.

Each outer perimetral rim 176 includes a bottom surface 182 that defines a rim plane 184 as shown in FIGS. 9 and 10. Rim planes 184 are spaced apart from and are substantially parallel with associated bottom surface planes 142. When folding leg assemblies 48, 50 are in the storage positions, legs 52 are positioned to lie between respective rim planes 184 and bottom surface planes 142. In addition, when first and second table sections 34, 36 are in the collapsed position, bottom surface 182 of perimetral rim 176 associated with first table section 34 engages bottom surface 182 of perimetral rim 176 associated with second table section 36 as shown in FIG. 3.

A horizontal portion 186 of reinforcing covers 156 is generally coplanar with rim plane 184 as shown in FIGS. 9 and 10. In addition, spaced apart vertical portions 188 of reinforcing covers extend from horizontal portion 186 away from rim plane 184 and through bottom surface plane. When first and second table sections 34, 36 are in the collapsed position, horizontal portions 186 of reinforcing covers 156 associated with first table section 34 engage horizontal portions 186 of reinforcing covers 156 associated with second table section 36.

Each side portion 180 of outer perimetral rim 176 is formed to include a handle recess 190 as shown in FIGS. 1, 2, 4 and 5. When table sections 34, 36 are in the collapsed position, handle recesses 190 formed in side portions 180 of perimetral rim 176 associated with first section 34 are positioned to lie adjacent to handle recesses 190 formed in side portions 180 of perimetral rim 176 associated with second table section 36 to define a hand-receiving aperture 192 as shown in FIG. 3.

A person can insert his or her hand through one of hand-receiving apertures 192 into the cavity created between table sections 34, 36. Each side portion 180 of perimetral rim includes a finger-engaging surface 194 that confronts one of vertical portions 188 of reinforcing covers 156. After the person has inserted his or her hand through hand-receiving aperture 192, the person can curl his or her fingers into engagement with finger-engaging surface 194, and if table 30 is in the orientation shown in FIG. 3, the person can vertically lift and carry folding table 30. Handle recesses 190 are positioned to lie substantially mid-way between table pivot axis 38 and end portions 178 of respective outer perimetral rims 176 so that table 30 is substantially balanced while being carried.

A first plug-and-socket set, including a plug 196 and a socket 198, is formed in end portion 178 of perimetral rim 176 of first table section 34 and a second plug-and-socket set, including a plug 200 and a socket 210 is formed in end portion 178 of perimetral rim 176 of second table section 36 as shown in FIGS. 2 and 4. Plug 196 is transversely aligned with socket 198 and plug 200 is transversely aligned with socket 210. When table sections 34, 36 are in the table position, plug 196 is longitudinally aligned with socket 210 and plug 200 is longitudinally aligned with socket 198. In addition, plugs 196, 200 and sockets 198, 210 are all substantially equidistant from table pivot axis 38.

Figure 13:
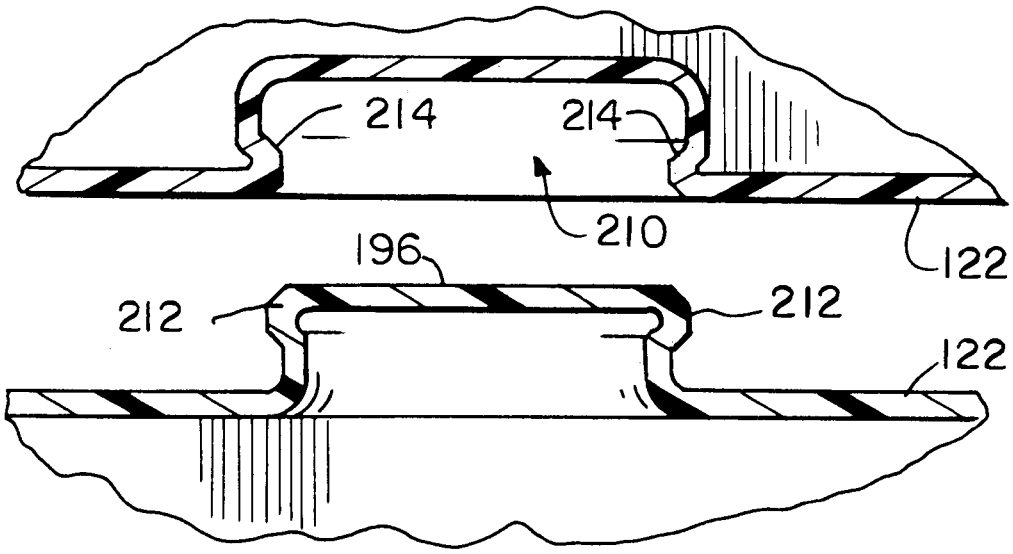
FIG. 13 is an enlarged end elevation view of a portion of the first and second table sections, with portions broken away, showing the table sections almost in the collapsed position having a socket formed in the first table section positioned to lie just above a plug formed in the second table section.
Figure 14:
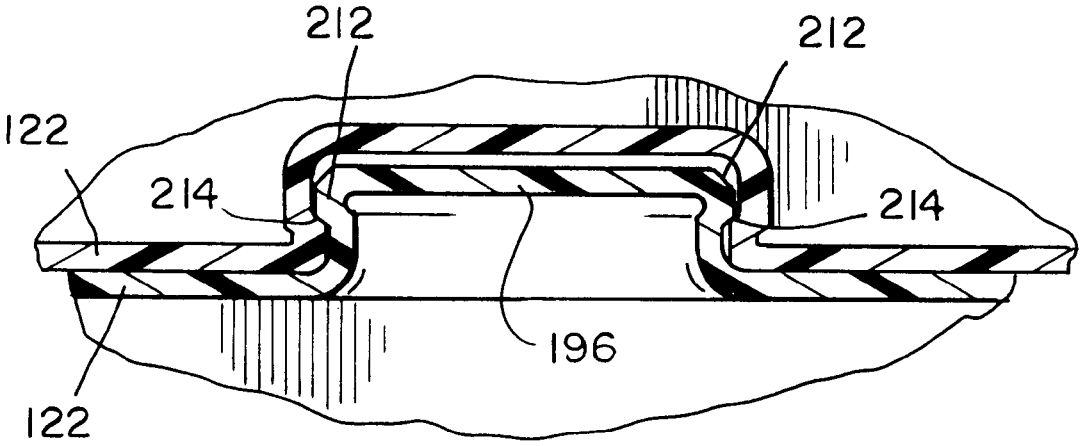
FIG. 14 is a view similar to FIG. 13 showing the first and second table sections in the collapsed position having the plug formed in the second table section received in the socket formed in the first table section to secure the table sections in the collapsed position.

When table sections 34, 36 are in the collapsed position, plug 196 is received in socket 210 and plug 200 is received in socket 198. Plugs 196, 200 are shaped to closely mate with respective sockets 198, 210 as shown in FIGS. 13 and 14 with respect to plug 196 and socket 200. Each plug 196, 200 protrudes away from end portion 178 of perimetral rim 176 and each socket 198, 210 is sunken into end portion 178 of perimetral rim 176. In addition, each plug 196, 200 is formed to include a pair of snap teeth 212 and bottom sheet of plastic 122 is formed to include a pair of snap ledges 214 that are positioned to lie in each of sockets 198, 210.

As table sections 34, 36 move from the position shown in FIG. 13 into the collapsed position, shown in FIG. 14, snap teeth 212 engage respective snap ledges 214 and either snap teeth 212, snap ledges 214, or both, yieldably deflect to allow snap teeth 212 to move past snap ledges 214 and into the associated socket 198, 210. The interference between snap teeth 212 and snap ledges 214, when table sections 34, 36 are in the collapsed position, secures plugs 196, 200 in respective sockets 210, 198, thereby securing table sections 34, 36 in the collapsed position.

Figure 15:
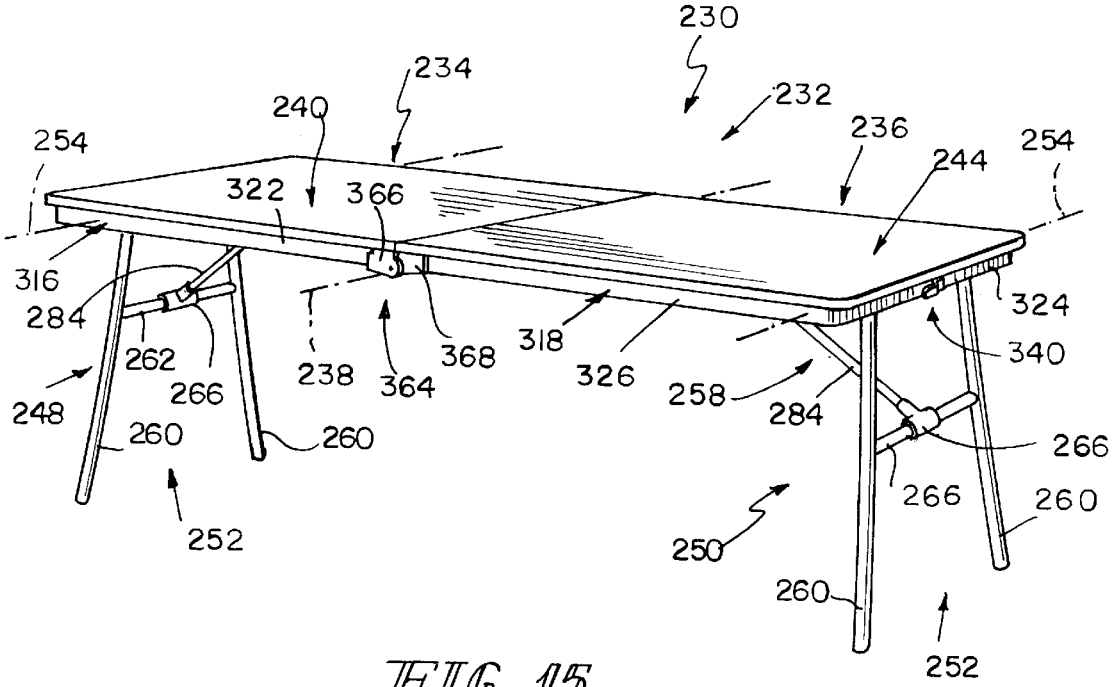
FIG. 15 is a perspective view of a second embodiment of a folding banquet table in accordance with the present invention showing first and second table sections opened to a table position in which the first and second table sections are aligned in horizontal relation and showing first and second folding leg assemblies beneath each of the first and second table sections, respectively.
Figure 17:
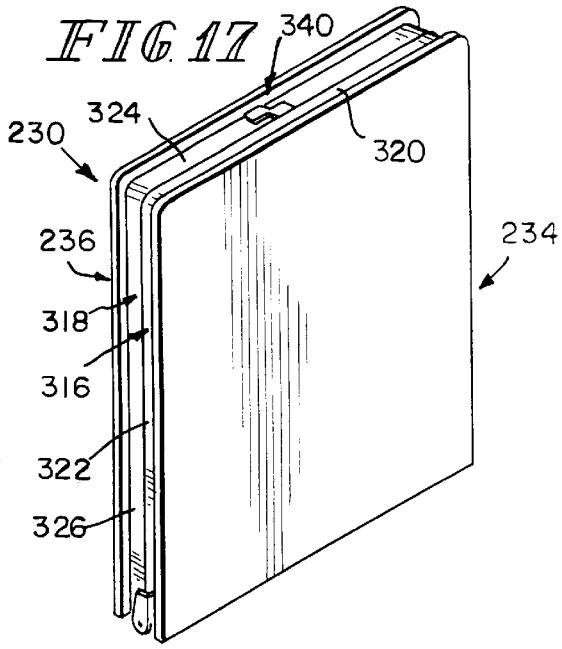
FIG. 17 is a perspective view of the table of FIG. 15 showing the first and second table sections locked in a collapsed position by a latch so that top sides of the first and second table sections face in opposite directions.
Figure 16:
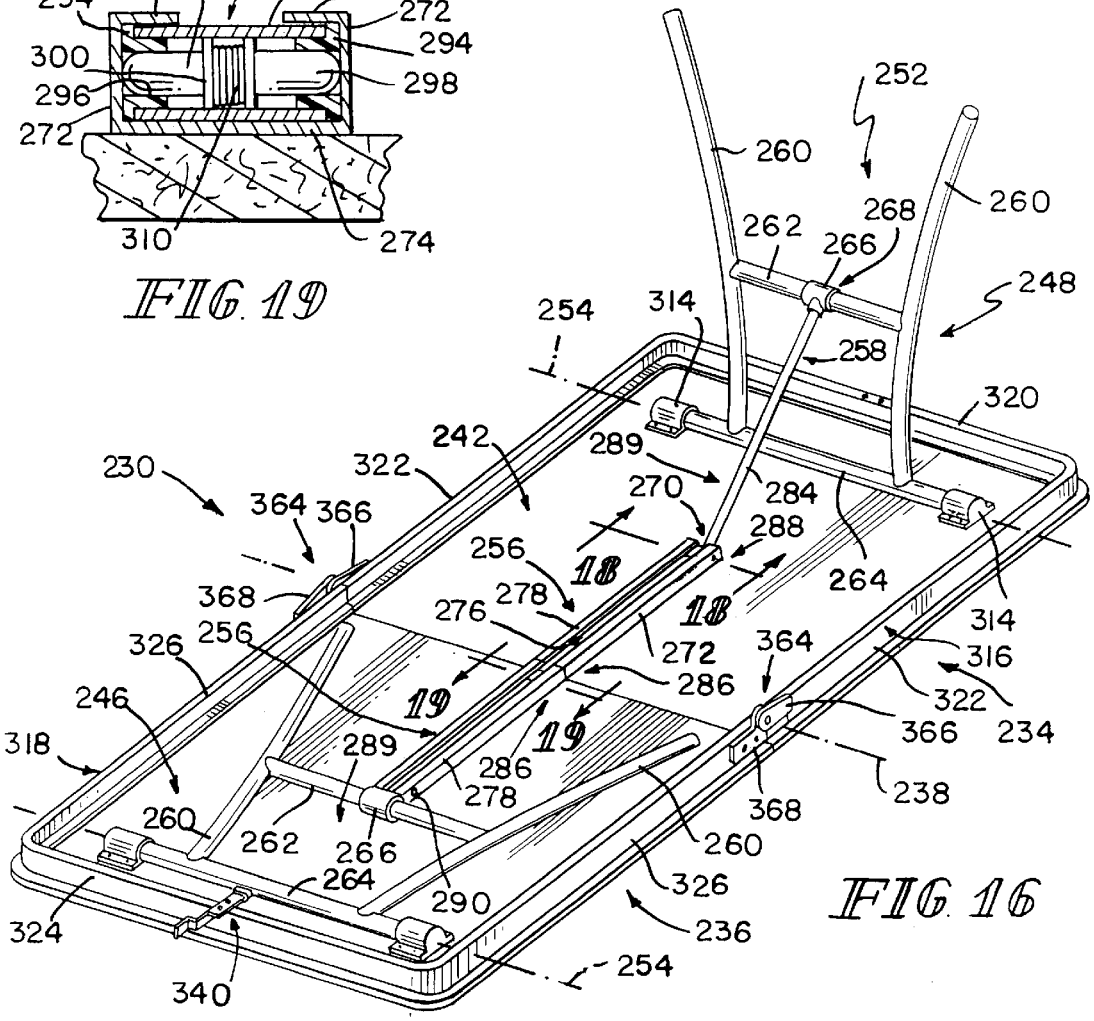
FIG. 16 is a perspective view of the table of FIG. 15 flipped over with the first and second table sections in the table position showing the first folding leg assembly in a support position having a leg of the first folding leg assembly extending away from the first table section, and the second folding leg assembly in a storage position having a leg of the second folding leg assembly adjacent to the second table section.

Second embodiment folding table 230 according to the present invention includes a table top 232 having a first table section 234 coupled to a second table section 236 for pivoting movement about a transverse table pivot axis 238 as shown in FIGS. 15–17.

First and second table sections 234, 236 can pivot about pivot axis 238 between an opened table position and a folded collapsed position that are similar to the table and collapsed positions of table sections 34, 36 of table 30. For example, table sections 234, 236 are horizontally aligned when in the table position, as shown in FIGS. 15 or 16, and are folded together when in the collapsed position, as shown in FIG. 17. Table 230 includes a latch 340, shown in FIGS. 20–24, that operates to lock table sections 234, 236 together when in the collapsed position.

First table section 234 includes a top side 240 and an underside 242 and second table section 236 includes a top side 244 and an underside 246. A first folding leg assembly 248 is coupled to underside 242 of first table section 234 and a second folding leg assembly 250 is coupled to underside 246 of second table section 236 as shown in FIGS. 15 and 16. Each folding leg assembly 248, 250 includes a leg 252 that can pivot about a transverse leg pivot axis 254 between support and storage positions that are similar to the support and storage positions of legs 52 associated with table 30.

When both folding leg assemblies 248, 250 are in the support position and table sections 234, 236 are in the table position, table 230 is in a standard table configuration, shown in FIG. 15, in which legs 252 support table top 232 above a floor (not shown). When folding leg assemblies 248, 250 are both in the storage positions, table sections 234, 236 can pivot about pivot axis 238 to the collapsed position without interference from folding leg assemblies 248, 250.

First folding leg assembly 248 and the operation of first folding leg assembly 248 is substantially the same as second folding leg assembly 250 and the operation of second folding leg assembly 250. Therefore, the description below of first folding leg assembly 248 and the operation of first folding leg assembly 248 is also descriptive of second folding leg assembly 250 and the operation of second folding leg assembly 250 unless specifically noted otherwise.

Leg 252 is substantially the same as leg 52 described above with reference to table 30. For example, leg 252 includes a pair of spaced-apart curved uprights 260, a cross strut 262 extending transversely between uprights 260, and a pivot member 264 to which upper portions of uprights 260 are attached as shown in FIG. 16. A channel member 256 is mounted to underside 242 and folding leg assembly 248 includes a support strut 258 coupling leg 252 to channel member 256 as also shown in FIG. 16. Support strut 258 of table 230 is substantially the same as support strut 58 of table 30. For example, support strut 258 includes a first end 268 formed to include a collar tube 266 that receives cross strut 262 for pivoting movement and a second end 270 formed to include a transverse end tube 82 that is coupled to channel member 256 for sliding movement.

Figure 18:
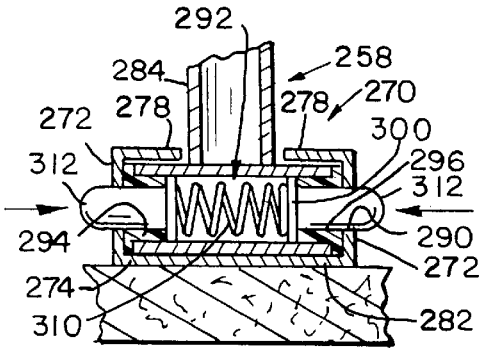
FIG. 18 is a sectional view taken along line 18—18 of FIG. 16 showing a support strut of the first folding leg assembly locked to the first table section by an opposing pair of lock pins that are spring-biased through respective apertures formed in a channel member mounted to the first table section.
Figure 19:
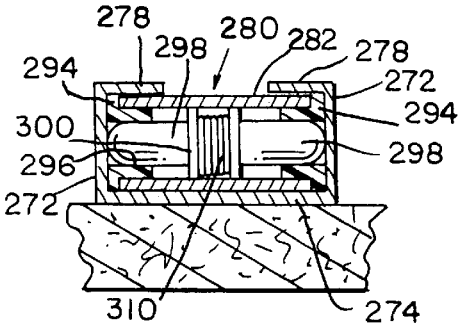
FIG. 19 is a sectional view taken along line 19—19 of FIG. 16 showing an opposing pair of lock pins of the second folding leg assembly positioned to lie inside a channel member mounted to the second table section.

Channel member 256 includes a pair of spaced-apart elongated side walls 272 and an elongated top wall 274 connecting side walls 272 so that a channel 276 having uniform height and width is defined between side walls 272. Channel member 256 also includes a pair of spaced-apart strut-retention walls 278, each of which is connected to one of side walls 272. Strut-retention walls 278 extend away from respective side walls 272 in perpendicular relation therewith to cover a portion of channel 276 as shown in FIGS. 18 and 19. Strut-retention walls 278 are spaced apart to define a strut-receiving gap 280 therebetween. Thus, the cross section of channel member 256 is substantially the same as the cross section of channel member 56.

Support strut 258 includes a single tubular bar 284 extending through strut-receiving gap 280 from end tube 282 to collar tube 266. Outer portions of end tube 282 are positioned to lie between respective strut-retention walls 278 and top wall 274 so that end tube 282 is trapped within channel 276 between side walls 272 of channel member 256.

Channel member 256 includes a first end 286 adjacent to pivot axis 238 and a second end 288 spaced apart from first end 286 and spaced apart from pivot member 264 to define an open space 289 between pivot member 264 and channel member 256. When table sections 234, 236 are in the table position, first end 286 of channel member 256 associated with first table section 234 abuts first end 286 of channel member 256 associated with second table section 236 to help support table sections 234, 236 in the table position.

When folding leg assembly 248 is in the storage position having leg 252 adjacent to underside 242, support strut 258 is in a folded position in which end tube 282 is positioned to lie adjacent to first end 286 of channel member 256. In addition, collar tube 266 and cross strut 262 are positioned to lie adjacent to second end 288 of channel member 256 in open space 289 when folding leg assembly 248 is in the storage position and tubular bar 284 is essentially completely positioned to lie inside channel 276 of channel member 256 as shown in FIG. 16 with respect to second folding leg assembly 250.

The movement of folding leg assembly 248 of table 230 back and forth between the storage and support positions is substantially the same as the movement of folding leg assembly 48 of table 30. For example, as leg 252 pivots about pivot axis 254 from the storage position toward the support position, cross strut 262 of leg 252 pulls collar tube 266 and tubular bar 284 away from underside 242 which causes end tube 282 to slide in channel 276 away from the first end 286 of channel member 256. As leg 252 pivots about leg pivot axis 254 from the support position toward the storage position, cross strut 262 of leg 252 pushes collar tube 266 and tubular bar 284 toward underside 242 which causes end tube 282 to slide in channel 276 toward first end 86 of channel member 56.

When leg 252 is in the storage position, support strut 258 is in a folded position having collar tube 266 and tubular bar 284 adjacent to underside 42 of first table section 234 and when leg 252 is in the support position, support strut 258 is in an unfolded position having collar tube 266 spaced apart from underside 242 of first table section 234. Leg 252 is positioned to lie outside channel 276 when leg 252 is in both the support and storage positions as was the case with leg 52 and channel 76. In addition, when leg 252 is in the storage position, channel member 256 is positioned to lie between uprights 260 as shown in FIG. 16 with respect to second folding leg assembly 250.

Each side wall 272 of channel member 256 is formed to include an aperture 290. Apertures 290 are formed as angled slots as was the case with apertures 90 of channel member 56 associated with table 30. End tube 282 includes an interior region 292 and an end plug 294 having a bore 296 is mounted in each end of end tube 282 in the same manner that end plugs 94 are mounted in end tubes 82 described above with reference to table 30.

A pair of lock pins 298 and a spring 310 are received in interior region 292. Each lock pin 298 includes a disk portion 300 and an outer tip 312. Lock pins 298 are movable between extended and retracted positions and operate in a manner substantially similar to lock pins 98 of table 30 to lock and unlock support strut 258 relative to channel member 256, thereby locking and unlocking leg 252 for pivoting movement relative to table sections 234, 236.

Illustrative first and second table sections 234, 236 of second embodiment folding table 230 are made out of a sheet of material, such as particle board or wood, having substantially flat top sides 240, 244 and substantially flat undersides 242, 246. A pair of mounting brackets 314 are coupled to undersides 242, 246 of respective table sections 234, 236 as shown in FIG. 16. Mounting brackets 314 are formed to receive ends of pivot members 264 so that legs 252 are coupled to respective table sections 234, 236 for pivoting movement about respective leg pivot axes 254. Each mounting bracket 314 includes an internal surface (not shown) that provides rotative bearing engagement between legs 252 and table section 234, 236.

A first U-shaped rail 316 is coupled to underside 242 of first table section 234 and a second U-shaped rail 318 is coupled to underside 246 of second table section as shown in FIG. 16. First U-shaped rail 316 includes a first end rail 320 and a pair of first side rails 322 integrally appended to first end rail 320. Second U-shaped rail 318 includes a second rail 324 and a pair of second side rails 326 integrally appended to second end rail 324. End rails 320, 324 are substantially parallel with table pivot axis 238. Side rails 322, 326 extend from respective end rails 320, 324 toward table pivot axis 238 in perpendicular relation therewith.

Each of end rails 320, 324 is inset by a slight amount from the perimetral edge of the respective table section 234, 236 so that table sections 234, 236 overhang U-shaped rails 316, 318 as shown in FIG. 15. The ends of side rails 322 associated with first table section 234 abut the ends of side rails 326 associated with second table section 236 when table sections 234, 236 are in the table position. Abutment of the ends of side rails 322 with the ends of side rails 326 helps to support table sections 234, 236 in the table position.

Table 230 includes a pair of hinges 364, each of which includes a first hinge plate 366 fastened to a respective side rail 322 of first U-shaped rail 316 mounted to first table section 234 and a second hinge plate 368 fastened to a respective side rail 326 of second U-shaped rail 318 mounted to second table section 36 as shown in FIG. 16. First hinge plates 366 are pivotably coupled to respective second hinge plates 368 at table pivot axis 238, thereby coupling first and second table sections 234, 236 together for pivoting movement about table pivot axis 238.

Figure 20:
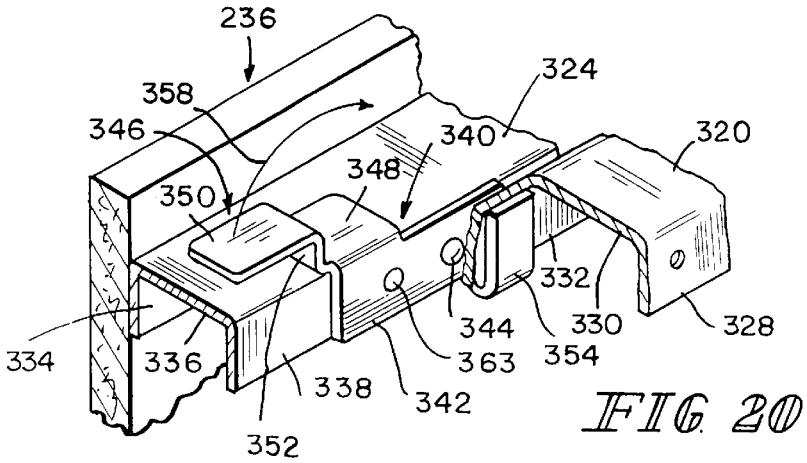
FIG. 20 is a perspective view of the table and latch of FIG. 17, with portions broken away, showing the latch including a middle plate coupled to an end rail mounted to one of the table sections, the latch including a hook that catches a lip of an end rail mounted to the other of the table sections to lock the table sections together, and the latch including a handle plate movable in the direction of the single arrow to unlock the table sections.
Figure 22:
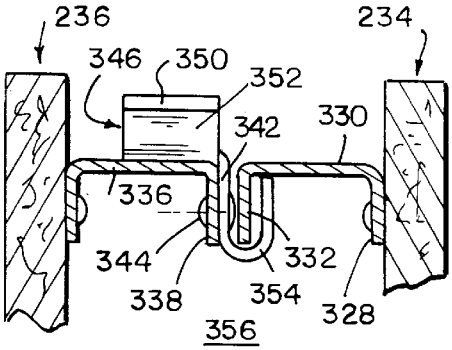
FIG. 22 is a sectional view of the table taken along line 22—22 of FIG. 21 showing the latch in the locking position having the hook catching the lip of the end rail of one of the table sections to lock the table sections together.
Figure 24:
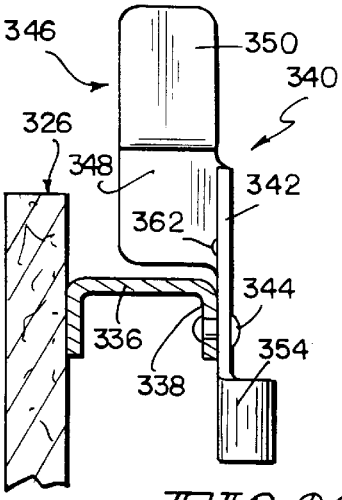
FIG. 24 is sectional view of the first table section and latch taken along line 24—24 of FIG. 23 after one table section has been folded away from the other table section showing the latch in the releasing position.

End rail 320 of first U-shaped rail 316 includes a table-engaging lip 328 that is fastened to underside 242 of first table section 234, a side wall 330 extending away from table-engaging lip 328, and a lip 332 extending away from side wall 330 toward table pivot axis 238 in parallel relation with table-engaging lip 328 as shown in FIGS. 20 and 22. End rail 324 of second U-shaped rail 318 includes a table-engaging lip 334 that is fastened to underside 246 of second table section 236, a side wall 336 extending away from table-engaging lip 334, and a lip 338 extending away from side wall 336 toward table pivot axis 238 in parallel relation with table-engaging lip 334 as shown in FIGS. 20, 22 and 24. When table sections 234, 236 are in the collapsed position, lip 332 confronts lip 338 and side wall 330 is aligned with side wall 336 as shown in FIGS. 20 and 22.

Figure 21:
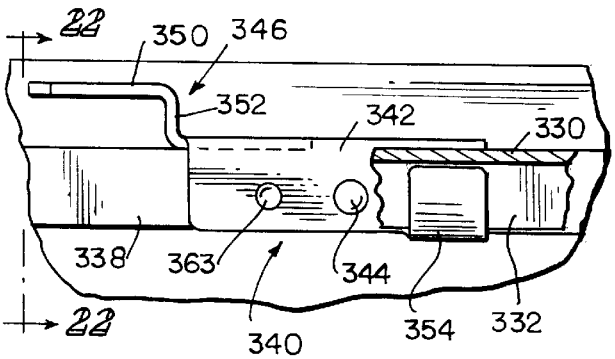
FIG. 21 is a partial plan view of the table and latch of FIG. 17, with portions broken away, showing the latch in a locking position locking the table sections together.
Figure 23:
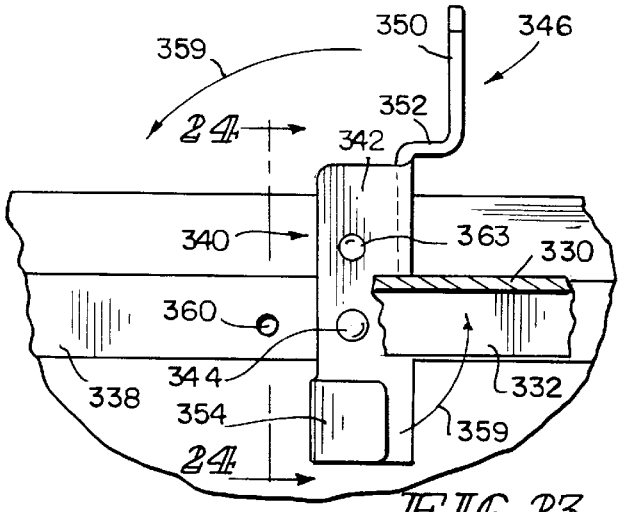
FIG. 23 is a view similar to FIG. 21 showing the latch in a releasing position having the hook spaced apart from the end rail of the one of the table sections and the latch being movable in the direction of the single arrows back to the locking position.

A latch 340 is pivotably coupled to lip 338 for movement between a locking position, shown in FIGS. 20–22, and a releasing position, shown in FIGS. 23 and 24. Latch 340 includes a middle plate 342 that is positioned to lie between lips 332, 338 when table sections 234, 236 are in the collapsed position. Middle plate 342 is coupled to lip 338 by a pivot pin 344. Latch 340 includes a stepped handle plate 346 having a stop tab 348, a grip tab 350, and a spacer tab 352 extending between stop tab 348 and grip tab 348. Latch 340 also includes a hook 354. Hook 354 and handle plate 354 are integrally appended to middle plate 342 at opposite ends thereof.

When table sections 234, 236 are in the collapsed position, first and second U-shaped rails 316, 318 cooperate with first and second table sections 234, 236 to define an inner cavity 356 as shown in FIG. 22. Latch 340 is configured so that when table sections 234 are in the collapsed position, hook 354 is positioned to lie inside cavity 356, middle plate 342 is positioned to lie between lips 332, 338, and handle plate 346 is positioned to lie outside cavity 356. When table sections 234, 236 are in the collapsed position and latch 340 is in the locking position, hook 354 is configured to catch lip 332, thereby locking table sections 234, 236 in the collapsed position as shown in FIGS. 20–22.

When latch 340 is in the locking position, stop tab 348 engages side wall 336 and grip tab 350 is offset from side wall 336 by spacer tab 352. A person can engage grip tab 350 and pivot latch 340 about pivot pin 344 in a direction indicated by arrow 358, shown in FIG. 20, from the locking position to the releasing position. As latch 340 pivots from the locking position toward the releasing position, handle plate 346 moves away from side wall 336 and hook 354 moves away from side wall 330 so that after latch 340 has been pivoted toward the releasing position by a sufficient amount, hook 354 no longer catches lip 332. After latch 340 is moved to the releasing position having hook 354 spaced apart from lip 332, table sections 234, 236 are unlocked and can be moved from the collapsed position to the table position.

Lip 338 is formed to include an aperture 360, shown in FIG. 23, and middle plate 342 includes a detent 362, shown in FIG. 24. Detent 362 can be formed on one side of middle plate 342 by punching middle plate 342 on an opposite side thereof so that a detent dimple 363 is formed on the punched side of middle plate 342. A person can engage grip tab 350 and pivot latch 340 in a direction indicated by arrows 359, shown in FIG. 23, from the releasing position to the locking position. Upon reaching the locking position, detent 362 is received in aperture 360 to secure latch 340 in the locking position.

Although the invention has been described in detail with reference to certain preferred embodiments and specific examples, variations and modifications exist within the scope and spirit of the invention as described and as defined in the following claims.

We claim:

1. A table comprising a table top having a central region and a perimeter surrounding the central region, a channel member spaced from the perimeter and defining a channel on the central region of the table top, and a folding leg assembly including a leg coupled to the table top for pivoting movement about a leg pivot axis and a support strut pivotably coupled to the leg and coupled to the channel member for sliding movement in the channel, the leg being pivotable about the leg pivot axis between a support position in which the leg lies outside the channel and extends away from the table top and a storage position in which the leg lies outside the channel and adjacent to the table top between the perimeter and the central region of the table top.

2. The table of claim 1, wherein the channel member includes an elongated top wall coupled to the table top, a pair of spaced-apart elongated side walls extending away from the top wall to define the channel therebetween, and a strut-retention wall extending away from each of the side walls, and the support strut includes a first end configured to be retained between the strut-retention walls and the top wall of the channel member.

3. The table of claim 2, wherein the support strut includes a second end spaced apart from the first end, the strut-retention walls are spaced apart to define a strut-receiving gap therebetween, and the support strut includes a single bar extending through the strut-receiving gap between the first and second ends of the support strut.

4. The table of claim 1, wherein the table top includes a top side, a bottom side spaced apart from the top side, and a table body between the top and bottom sides, the table body is formed to include a recess that receives the channel member therein, and the channel member is positioned to lie between the top and bottom sides of the table top.

5. The table of claim 1, wherein the table top includes a first table section and a second table section pivotably coupled to the first table section and the first and second table sections cooperate to provide the central region and perimeter of the table top.

6. The table of claim 1, wherein the table top has a width and a length that is greater than the length and the channel member is parallel to the table length and in alignment with a mid-point of the width.

7. The table of claim 1, wherein the channel includes a pair of side walls that cooperate to define a downwardly facing opening in which the support strut is positioned to slide.

8. A table comprising a table top, a channel member defining a channel on the table top, and a folding leg assembly including a leg coupled to the table top to pivot about a leg pivot axis and a support strut pivotably coupled to the leg and slidably coupled to the channel member to move therein, the leg being pivotable about the leg pivot axis between a support position in which the leg lies outside the channel and extends away from the table top and a storage position in which the leg lies adjacent to the table top, the leg including first and second uprights, the second upright being positioned to lie in spaced-apart relation to the first upright to receive the channel member therebetween upon movement of the leg to the storage position adjacent to the table top.

9. The table of claim 8, wherein the leg further includes a pivot member supported for rotation relative to the table top about the leg pivot axis and the pivot member is coupled to the first and second uprights.

10. The table of claim 9, wherein the table top further includes at least one leg cradle appended thereto and configured to support the pivot member for rotation and a retainer retaining the pivot member in a rotatable position in the at least one leg cradle.

11. The table of claim 8, wherein the leg further includes a cross strut coupled to the first and second uprights and extending therebetween, the support strut is pivotably coupled to the cross strut, and the cross strut is positioned to lie between the leg pivot axis and the channel member upon movement of the leg to the storage position adjacent to the table top.

12. The table of claim 11, wherein the leg further includes a pivot member supported for rotation relative to the table top about the leg pivot axis and arranged to lie in spaced-apart parallel relation to the cross strut and the pivot member is coupled to the first and second uprights so that the first and second uprights pivot about the leg pivot axis during movement of the leg between its support and storage positions.

13. A table comprising a table top having a central region and a perimeter around the central region, a channel member defining a channel on the table top, and a folding leg assembly including a leg coupled to the table top to pivot about a leg pivot axis and a support strut pivotably coupled to the leg and slidably coupled to the channel member to move therein, the leg being pivotable about the leg pivot axis between a support position in which the leg lies outside the channel and extends away from the table top and a storage position in which the leg lies outside the channel and adjacent to the table top between the perimeter and the central region of the table top, the channel member including a pair of side walls extending away from the table top, the channel being defined between the side walls.

14. The table of claim 13, wherein at least one of the side walls of the channel member is formed to include an aperture and the folding leg assembly further includes a lock pin coupled to the support strut for movement relative thereto between a first position in which the lock pin is received by the aperture to prevent the support strut from sliding in the channel and a second position in which the lock pin is retracted out of the aperture to allow the support strut to slide in the channel.

15. The table of claim 14, wherein the folding leg assembly further includes a spring engaging the lock pin to bias the lock pin toward the first position.

16. The table of claim 13, wherein each of the side walls of the channel member is formed to include an aperture, the folding leg assembly further includes a pair of lock pins coupled to the support strut, each lock pin being movable relative to the support strut between a first position received by the respective aperture to prevent the support strut from sliding in the channel and a second position retracted out of the respective aperture to allow the support strut to slide in the channel.

17. The table of claim 16, wherein the folding leg assembly further includes a spring between the lock pins, the spring engaging the lock pins to bias the lock pins toward the respective first positions.

18. The table of claim 17, wherein the support strut includes a single transversely extending end tube having an interior region, the spring is received in the interior region of the end tube, and the pair of lock pins each include a portion received in the interior region of the end tube.

19. The table of claim 16, wherein the central region of the table top is formed to include a longitudinal recess that receives the channel member, the table top is formed to include a pair of hand pockets on opposite sides of the channel member, and each lock pin includes an outer tip positioned to lie in the respective hand pocket when the leg is in the support position and the respective lock pin is in the first position.

20. The table of claim 19, wherein the table top includes a pair of retention ribs and the retention ribs engage the channel member to retain the channel member in the recess formed in the central region of the table top.

21. A folding table comprising a table top including a first table section and a second table section, the first table section being coupled to the second table section for pivoting movement about a table pivot axis between a table position in which the first and second table sections are aligned in horizontal relation and a collapsed position in which the first and second table sections are folded together, each of the first and second table sections having a central region and a perimeter around the central region, a first channel member coupled to the first table section and defining a channel on the central region of the first table section, a second channel member coupled to the second table section and defining a channel on the central region of the second table section, and a pair of folding leg assemblies, each folding leg assembly including a leg pivotably coupled to the respective table section for movement about a respective leg pivot axis and a support strut pivotably coupled to the respective leg and having a portion received in the respective channel for sliding movement, the leg of each folding leg assembly being pivotable about the respective leg pivot axis between a support position in which the leg lies outside the respective channel and extends away from the respective table section and a storage position in which the leg lies outside the respective channel adjacent to the respective table section.

22. The folding table of claim 21, wherein each of the first and second table sections includes a top side, a bottom side, and a table body between the top and bottom sides and the first and second channel members are recessed into the table bodies between the top and bottom sides of the respective first and second table sections.

23. The folding table of claim 22, wherein each of the legs includes first and second uprights and a cross strut extending between the first and second uprights, the cross strut extends across the respective channel when the respective leg is in the storage position, and portions of each cross strut are positioned to lie on opposite sides of the respective channel member adjacent to the bottom side of the respective first and second table section when the respective leg is in the storage position.

24. The folding table of claim 21, wherein each of the channel members includes a first end adjacent to the table pivot axis and a second end spaced apart from the table pivot axis, the second end of each channel member is spaced apart from the respective leg pivot axis to define an open space therebetween, each of the legs includes first and second uprights and a cross strut extending between the first and second uprights, and each cross strut is received in the open space between the second end of the respective channel member and the respective leg pivot axis when the respective leg is in the storage position.

25. The folding table of claim 24, wherein the respective channel member is positioned to lie between the first and second uprights when the respective leg is in the storage position.

26. A folding table comprising a table top including a first table section and a second table section, the first table section being coupled to the second table section to pivot about a table pivot axis between a table position in which the first and second table sections are aligned in horizontal relation and a collapsed position in which the first and second table sections are folded together, each of the first and second table sections being made of a plastics material, each first and second table section having a respective interior region, at least one of the first and second table sections being formed to include an outer perimetral rim formed to include a handle recess to define a hand-receiving aperture between the first and second table sections.

27. A folding table comprising a table top including a first table section and a second table section, the first table section being coupled to the second table section to pivot about a table pivot axis between a table position in which the first and second table sections are aligned in horizontal relation and a collapsed position in which the first and second table sections are folded together, each of the first and second table sections being made of a plastics material, each first and second table section having a respective interior region, each of the first and second table sections including a top sheet of plastic, a bottom sheet of plastic, and a perimetral side sheet of plastic integrally coupling the top sheet of plastic to the bottom sheet of plastic so that the respective interior regions are enclosed by the respective top, bottom, and perimetral side sheets of plastic and the bottom sheet of plastic is formed to include a plurality of portions that engage the top sheet of plastic in the interior region to rigidify the top sheet of plastic.

28. The folding table of claim 26, wherein the first and second table sections are each formed to include an outer perimetral rim, each perimetral rim is formed to include at least one handle recess, and the at least one handle recess of the first table section is positioned to lie adjacent to the at least one handle recesses of the second table section when the first and second table sections are in the collapsed position to define the hand-receiving aperture between the first and second table sections.

29. A folding table comprising a table top including a first table section and a second table section, the first table section being coupled to the second table section to pivot about a table pivot axis between a table position in which the first and second table sections are aligned in horizontal relation and a collapsed position in which the first and second table sections are folded together, each of the first and second table sections being made of a plastics material, each first and second table having a respective interior region, the first and second table sections being formed to include an outer perimetral rim, each perimetral rim including a transverse end portion arranged in spaced-apart parallel relation with the table pivot axis, the end portion of the outer perimetral rim of the first table section being formed to include a first plug and a first socket, the end portion of the outer perimetral rim of the second table section being formed to include a second plug and a second socket, the first plug being received in the second socket, the second plug being received in the first socket to secure the first and second table sections in the collapsed position.

30. A folding table comprising a table top including a first table section and a second table section, the first table section being coupled to the second table section to pivot about a table pivot axis between a table position in which the first and second table sections are aligned in horizontal relation and a collapsed position in which the first and second table sections are folded together, each of the first and second table sections being made of a plastics material, each first and second table section having a respective interior region, the leg of each first and second folding leg assembly including a pivot member, the first and second table sections being formed to include a leg cradle, each leg cradle extends transversely in parallel relation with the table pivot axis, each leg cradle including a curved surface in contact with the pivot member of the respective leg to provide rotative bearing engagement between the pivot member of the respective leg and the respective first and second table section.

31. A folding table comprising a table top including a first table section and a second table section, the first table section being coupled to the second table section to pivot about a table pivot axis between a table position in which the first and second table sections are aligned in horizontal relation and a collapsed position in which the first and second table sections are folded together, each of the first and second table sections being made of a plastics material, each first and second table section having a respective interior region, the first and second table sections being formed to include a pair of spaced-apart support rails, each support rail extending longitudinally in perpendicular relation with the table pivot axis, and further comprising a plurality of reinforcing covers that cover the respective support rails.

32. The folding table of claim 31, wherein each support rail includes an end surface adjacent to the table pivot axis, and the end surfaces of the support rails of the first table section abut the end surfaces of the support rails of the second table section when the first and second table sections are in the table position.

33. The folding table of claim 31, further comprising a pair of hinges, each hinge including a first hinge plate coupled to the respective reinforcing cover that covers the support rails of the first table section, each hinge including a second hinge plate coupled to the respective reinforcing cover that covers the support rails of the second table section, and the first hinge plate being coupled to the respective second hinge plate for pivoting movement about the table pivot axis.

34. The folding table of claim of 31, wherein the first and second legs each include a pivot member, each reinforcing cover is formed to include an aperture, each pivot member includes a first and second end, and the first and second ends of the respective pivot members are received for pivoting movement by the apertures formed in respective reinforcing covers.

35. A folding table comprising a table top including a first table section and a second table section, the first table section being coupled to the second table section to pivot about a table pivot axis between a table position in which the first and second table sections are aligned in horizontal relation and a collapsed position in which the first and second table sections are folded together, each of the first and second table sections being made of a plastics material, each first and second table section having a respective interior region, the first and second table sections being formed to include respective first and second abutment rails adjacent to and parallel with the table pivot axis, each abutment rail including a first abutment surface and a second abutment surface perpendicular to the respective first abutment surface, the first abutment surface of the first table section abutting the first abutment surface of the second table section when the first and second table sections are in the table position, and the second abutment surface of the first table section abutting the second abutment surface of the second table section when the first and second table sections are in the collapsed position.

36. A folding table comprising a table top including a first table section and a second table section, each of the first and second table sections including an outer perimetral rim, the first and second table sections being coupled together for pivoting movement about a table pivot axis between a table position in which the table sections are aligned in horizontal relation and a collapsed position in which the table sections are folded together having the outer perimetral rim of the first table section abutting the outer perimetral rim of the second table section, the outer perimetral rim of the first table section being formed to include a first handle recess, the outer perimetral rim of the second table section being formed to include a second handle recess, the first handle recess being adjacent to the second handle recess when the first and second table sections are in the collapsed position to provide a hand-receiving aperture between the outer perimetral rims of the first and second table sections.

37. The folding table of claim 36, wherein each of the outer perimetral rims includes a longitudinal portion perpendicular to the table pivot axis and a transverse end portion spaced apart from and parallel with the table pivot axis and each of the handle recesses are formed in the longitudinal portion of the respective outer perimetral rim.

38. The folding table of claim 37, wherein the handle recess formed in the longitudinal portion of each outer perimetral rim is situated at a position that is approximately half way between the table pivot axis and the transverse end portion of the outer perimetral rim.

39. The folding table of claim 36, wherein a cavity is formed between the first and second table sections when the first and second table sections are in the collapsed position and the hand-receiving aperture provides access to the cavity.

40. A folding table comprising a table top including a first table section and a second table section coupled to the first table section for pivoting movement about a pivot axis between a table position in which the first and second table sections are aligned in horizontal relation and a collapsed position in which the first and second table sections are folded together, the first table section being formed to include a socket, the second table section being formed to include a plug, the plug being received in the socket when the first and second table sections are in the collapsed position to secure the first and second table sections in the collapsed position.

41. The folding table of claim 40, wherein the plug is formed to include a snap tooth, the first table section is formed to include a snap ledge in the socket, and the snap ledge engages the snap tooth to secure the plug in the socket.

42. The folding table of claim 40, wherein the first table section is formed to include a plug, the second table section is formed to include a socket, the first table section includes a first transverse end spaced apart from and parallel with the pivot axis, the second table section includes a second transverse end spaced apart from and parallel with the pivot axis, the plug and the socket of the first table section formed in the first table section are adjacent to the first transverse end, and the plug and the socket formed in the second table section are adjacent to the transverse second end.

43. The folding table of claim 42, wherein the plug formed in the first table section is transversely spaced apart from the socket formed in the first table section and the plug formed in the second table section is transversely spaced apart from the socket formed in the second table section.

44. A table comprising a table top having a length greater than its width a channel member defining a channel on the table top, the channel being parallel to the table length and in alignment with a mid-point of the width, and a folding leg assembly including a leg coupled to the table top to pivot about a leg pivot axis and a support strut pivotably coupled to the leg and coupled to the channel member to slide therein, the leg being pivotable about the leg pivot axis between a support position in which the leg lies outside the channel and extends away from the table top and a storage position in which the leg lies outside the channel and adjacent to the table top.

45. The table of claim 44, wherein the folding leg assembly includes only a single support strut extending from the channel member to the leg.

46. The table of claim 44, wherein the channel member includes a pair of side walls defining an downwardly facing opening that receives a portion of the support strut.

47. The table of claim 44, wherein the channel member is C-shaped.

48. The table of claim 44, wherein the table top is formed to include a recess configured to receive the channel member therein.

49. The table of claim 44, wherein the single support strut is coupled to a central portion of the leg.

50. A table comprising a table top, a channel member defining a channel on the table top, and a folding leg assembly including a leg coupled to the table top to pivot about a leg pivot axis and only a single support strut pivotably coupled to the leg and coupled to the channel member to slide therein, the leg being pivotable about the leg pivot axis between a support position in which the leg lies outside the channel and extends away from the table top and a storage position in which the leg lies outside the channel and adjacent to the table top and wherein the single support strut maintains the extended away position of the leg in the support position.

51. The table of claim 50, wherein the leg includes a pair of spaced apart uprights and the single support strut is positioned between the uprights.

52. The table of claim 50, wherein the table top includes a width and a length that is greater than the width and the single support strut is positioned at a midpoint of the width.

* * * * *